US009782886B2

(12) United States Patent
Chuang

(10) Patent No.: US 9,782,886 B2
(45) Date of Patent: Oct. 10, 2017

(54) COMPACT HAND TOOL WITH SLIDING COVER

(71) Applicant: Louis Chuang, Taichung (TW)

(72) Inventor: Louis Chuang, Taichung (TW)

( * ) Notice: Subject to any disclaimer, the term of this patent is extended or adjusted under 35 U.S.C. 154(b) by 0 days.

(21) Appl. No.: 15/008,603

(22) Filed: Jan. 28, 2016

(65) Prior Publication Data

US 2016/0311106 A1 Oct. 27, 2016

(30) Foreign Application Priority Data

Apr. 21, 2015 (TW) ..... 104112667 A

(51) Int. Cl.

| | |
|---|---|
| ***B25G 1/08*** | (2006.01) |
| ***B25G 1/06*** | (2006.01) |
| ***B25B 15/00*** | (2006.01) |
| ***B25B 23/12*** | (2006.01) |

(52) U.S. Cl.

CPC ..... *B25G 1/085* (2013.01); *B25B 15/00* (2013.01); *B25B 23/12* (2013.01); *B25G 1/063* (2013.01)

(58) Field of Classification Search

CPC ..... B25F 1/02; B25G 1/085; B25G 1/105
See application file for complete search history.

(56) References Cited

U.S. PATENT DOCUMENTS 804,679 A * 11/1905 Searle ..... B25B 15/007 254/19
2,487,696 A * 11/1949 Coffing ..... B25F 1/02 172/762
4,235,269 A * 11/1980 Kraus ..... B25B 15/04 81/177.4
4,926,721 A * 5/1990 Hsiao ..... B25G 1/085 81/124.4
5,450,775 A * 9/1995 Kozak ..... B25B 15/02 81/177.4
5,613,413 A * 3/1997 Huang ..... B25B 23/0035 81/177.4
5,740,706 A * 4/1998 Tseng ..... B25B 15/04 81/177.4
6,186,036 B1 * 2/2001 Huang ..... B25G 1/066 81/177.4
6,196,093 B1 * 3/2001 Hu ..... B25G 1/085 16/111.1

(Continued)

FOREIGN PATENT DOCUMENTS

GB 2194476 A * 3/1988 ..... B25B 13/06
IT FR 2508367 A3 * 12/1982 ..... B25F 1/02

(Continued)

*Primary Examiner* — Larry E Waggle, Jr.
*Assistant Examiner* — Tyrone V Hall, Jr.
(74) *Attorney, Agent, or Firm* — Alan D. Kamrath; Kamrath IP Lawfirm, P.A.

(57) ABSTRACT

A hand tool includes a handle and a driving head. The handle includes a first driving recess, a second driving recess disposed opposite to the first driving recess, a body made of a first material, and a cover member mounted around an outer surface of the body and made of a second material different from the first material. The handle further includes a first receiving recess therein. The driving head includes a connection portion alternatively engaged into one of the first driving recess and the second driving recess to provide a stationary connection between the handle and the driving head.

10 Claims, 11 Drawing Sheets

(56) References Cited

U.S. PATENT DOCUMENTS

| | | | | |
|---|---|---|---|---|
| 6,237,451 | B1 * | 5/2001 | Wei | B25G 1/085 81/177.4 |
| 6,305,255 | B1 * | 10/2001 | Wu | B25B 15/02 81/177.4 |
| 6,571,669 | B2 * | 6/2003 | Benatz | B25G 1/085 206/350 |
| 6,574,817 | B2 | 6/2003 | Wu | |
| 6,606,925 | B1 * | 8/2003 | Gmeilbauer | B25B 13/461 81/177.1 |
| 6,629,478 | B2 * | 10/2003 | Kozak | B25G 1/085 81/177.4 |
| 6,698,318 | B2 * | 3/2004 | Peters | B25B 13/56 81/177.4 |
| 7,600,640 | B2 * | 10/2009 | Hallee | B25H 3/003 206/373 |
| 2008/0083304 | A1 * | 4/2008 | Finn | B25B 13/461 81/177.4 |
| 2009/0126538 | A1 * | 5/2009 | Miers | B25B 23/0035 81/177.85 |

FOREIGN PATENT DOCUMENTS

| | | | | |
|---|---|---|---|---|
| TW | 529523 | U | | 4/2003 |
| TW | I344407 | B | | 7/2011 |
| TW | 20130208959 | U | * | 11/2013 |
| TW | M465256 | U | | 11/2013 |

* cited by examiner

COMPACT HAND TOOL WITH SLIDING COVER

BACKGROUND

The present invention relates to a hand tool and, more particularly, to a compact, lightweight, and easy to carry hand tool.

Taiwan Patent No. 529523 discloses a multi-functional tool set for bicycles, which includes a tool body (10) having a first end, a second end, and a storage space (16) disposed between the first and second ends; a socket (20) pivotally connected to the first end of the tool body (10) to be positioned at a variety of angles with respect to the tool body (10); a tool receiver (30) having a plurality of recesses (35) to store different types of tool bits (36) and pivotally connected to the second end of the tool body (10) to be received within the storage space (16); and at least one tool (40) slidably mounted at one side of the tool body (10). The tool bits (36) mounted to the socket (20) can be selectively positioned at a variety of angles with respect to the tool body (10) for effectively driving a fastener.

However, the multi-functional tool set slipping from hands easily causes collision damage to a user due to a nonstationary connection between the tool body (10) and the socket (20). Hence, the user must control and turn the tool body (10) carefully to prevent it slipping from hands.

Moreover, the socket (20) is pivotally connected to the tool body (10) by a screw, a nut and a bolt, which is easily deformed under high torque, resulting in low structure strength of the multi-functional tool set.

Thus, a need exists for a novel compact hand tool to mitigate and/or obviate the above disadvantages.

BRIEF SUMMARY

This need and other problems in the field of hand tools are solved by a hand tool including a handle and a driving head. The handle has a first end, a second end spaced from the first end along an extending axis, a first side, and a second side spaced from the first side along a first axis perpendicular to the extending axis. The first end includes a first driving recess extending from the first side to the second side along the first axis. The second end includes a second driving recess extending along a second axis perpendicular to the first axis. The handle includes a body extending from the first side to the second side and made of a first material, and a cover member mounted around an outer surface of the body and made of a second material different from the first material. The handle further includes a first receiving recess extending parallel to the first axis.

The driving head includes a connection portion alternatively engaged into one of the first driving recess and the second driving recess to provide a stationary connection between the handle and the driving head.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
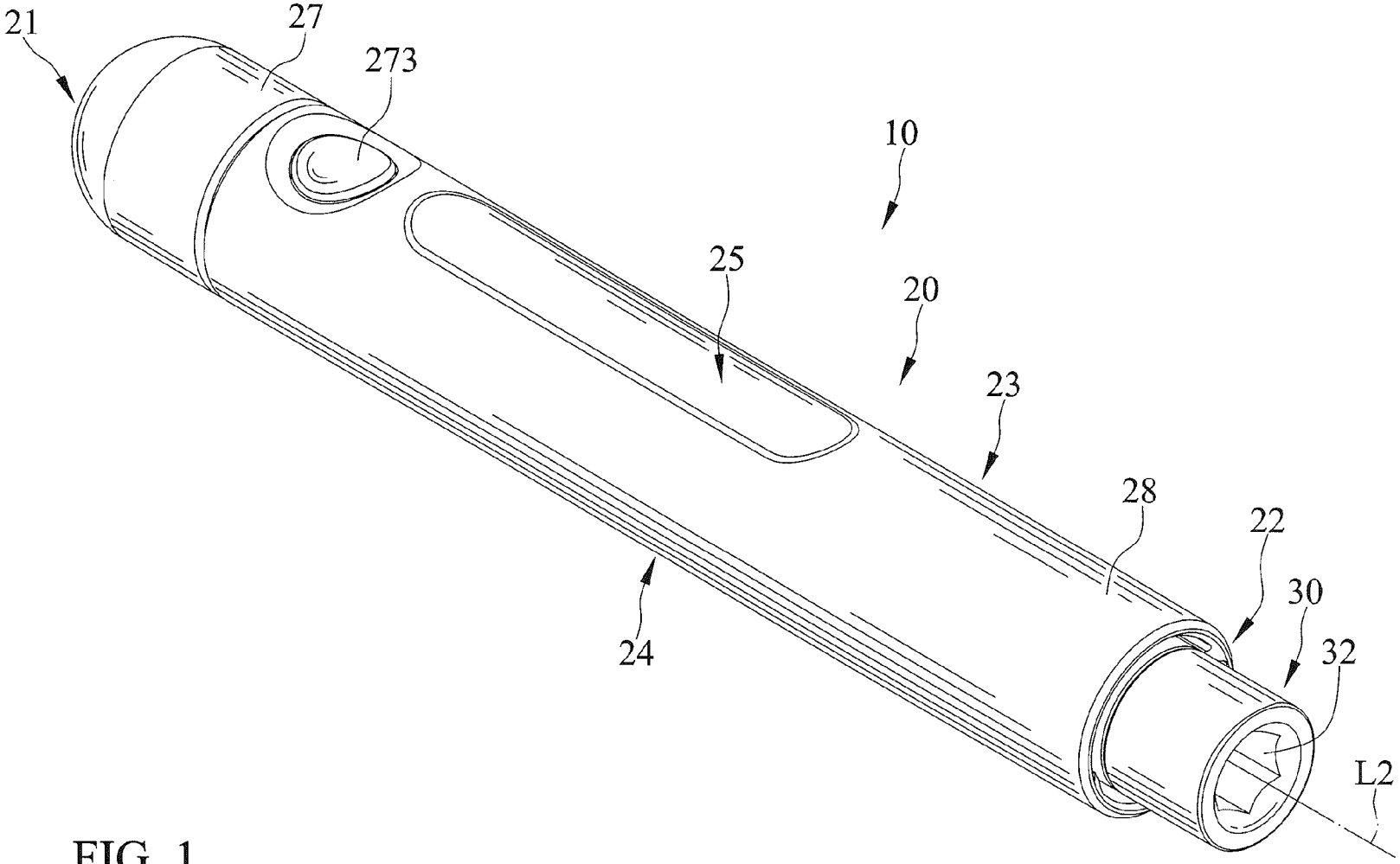
FIG. 1 is a perspective view of a hand tool according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "spacing", "length", "depth", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION

Figure 2:
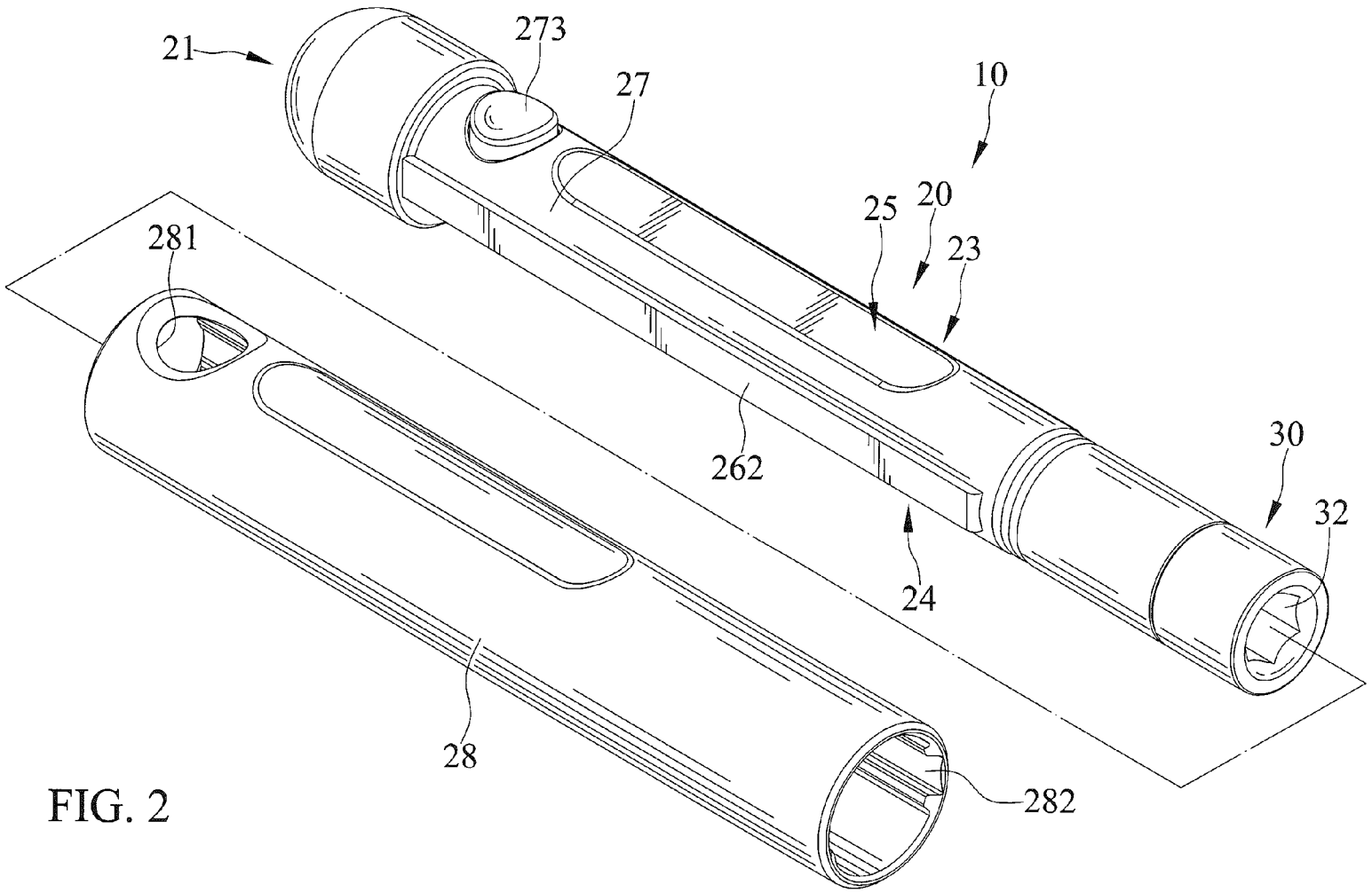
FIG. 2 is an exploded, perspective view of a housing of the hand tool of FIG. 1, and illustrates the housing detachably mounted around a cover member.
Figure 3:
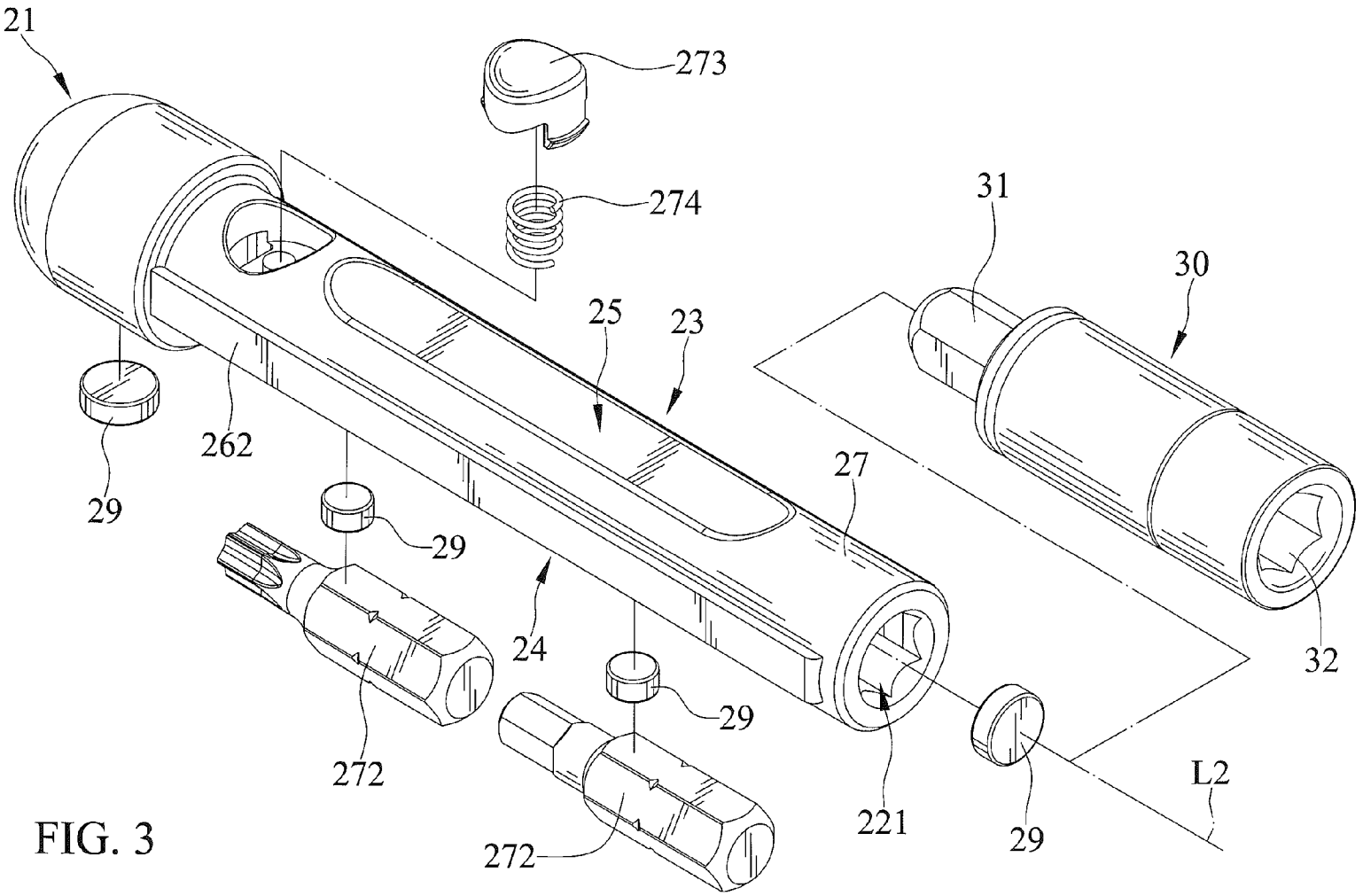
FIG. 3 is an exploded, perspective view of the hand tool of FIG. 1.
Figure 4:
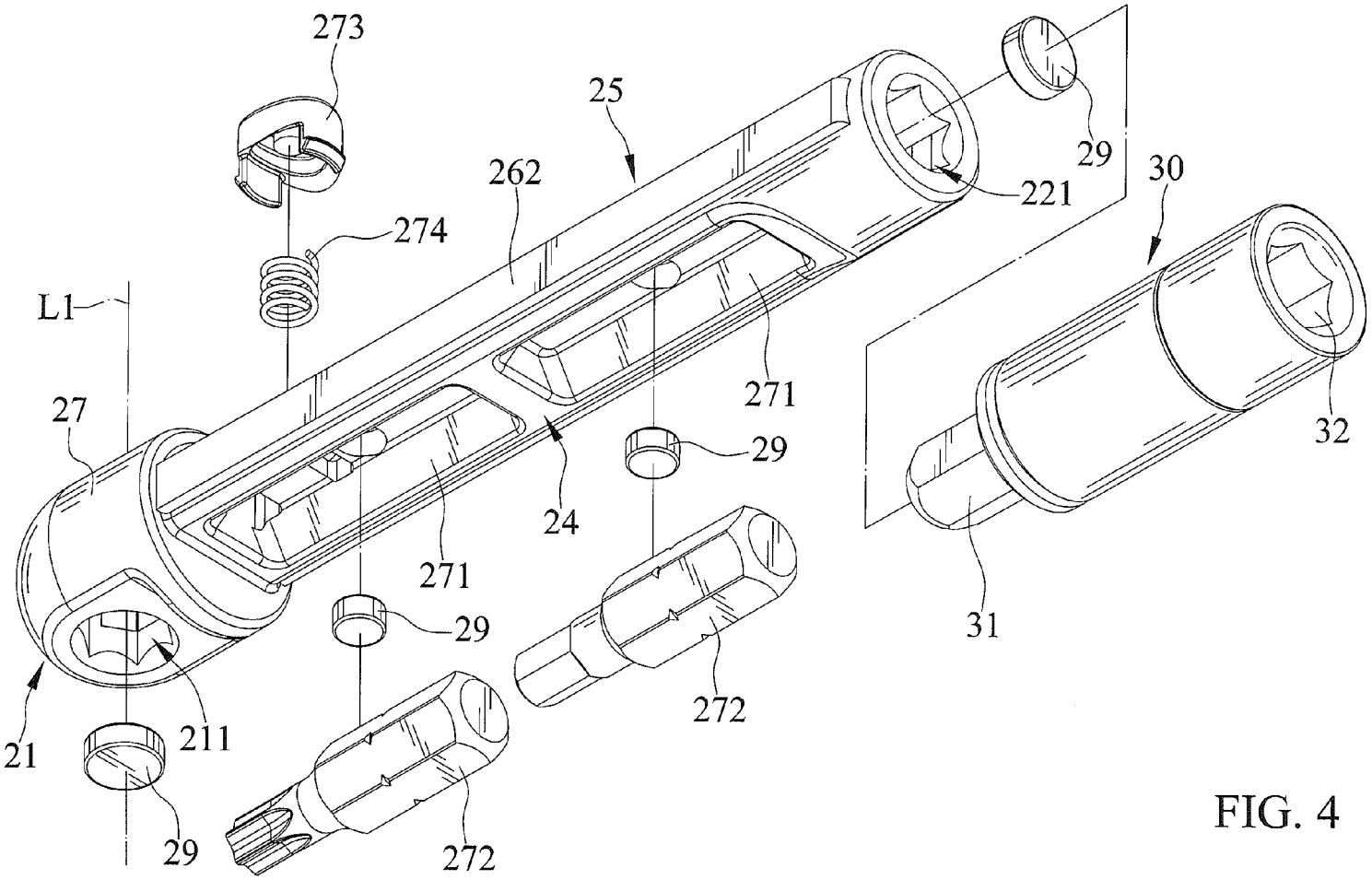
FIG. 4 is another exploded, perspective view of the hand tool of FIG. 1.
Figure 5:
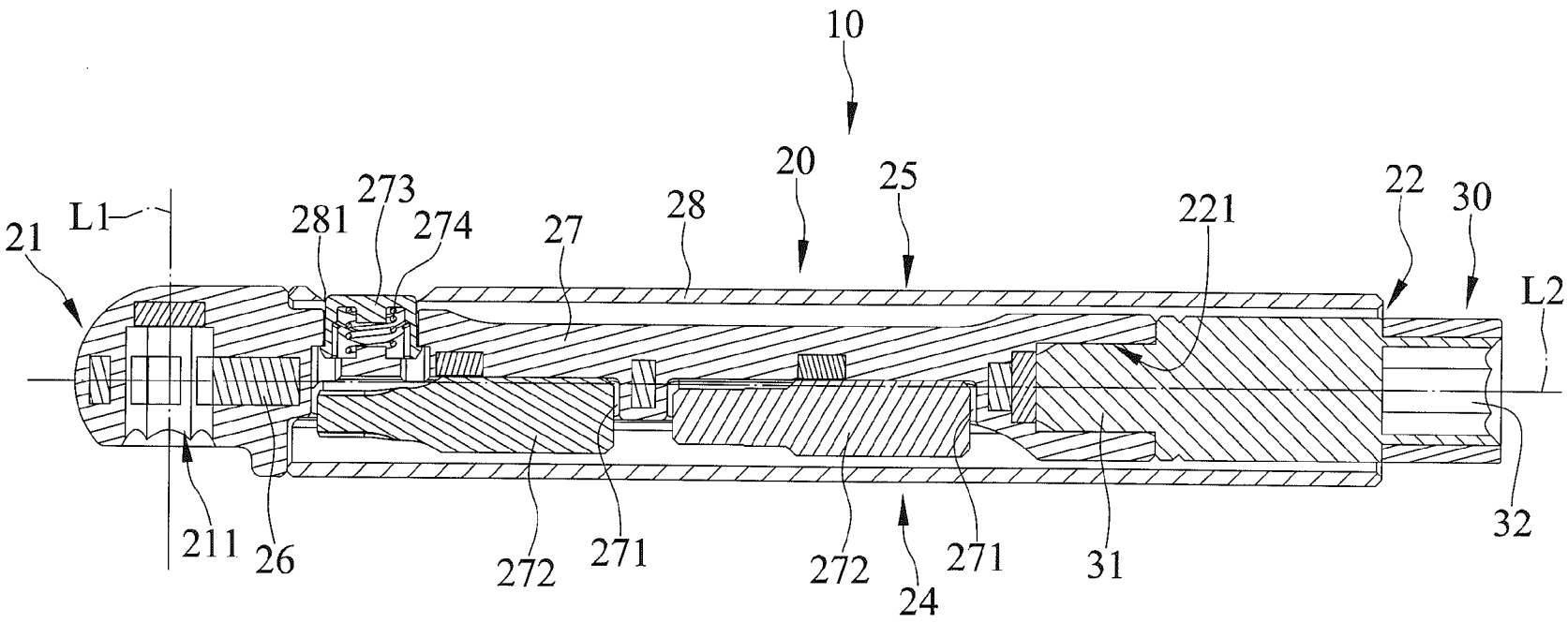
FIG. 5 is a cross sectional view of the hand tool of FIG. 1.
Figure 6:
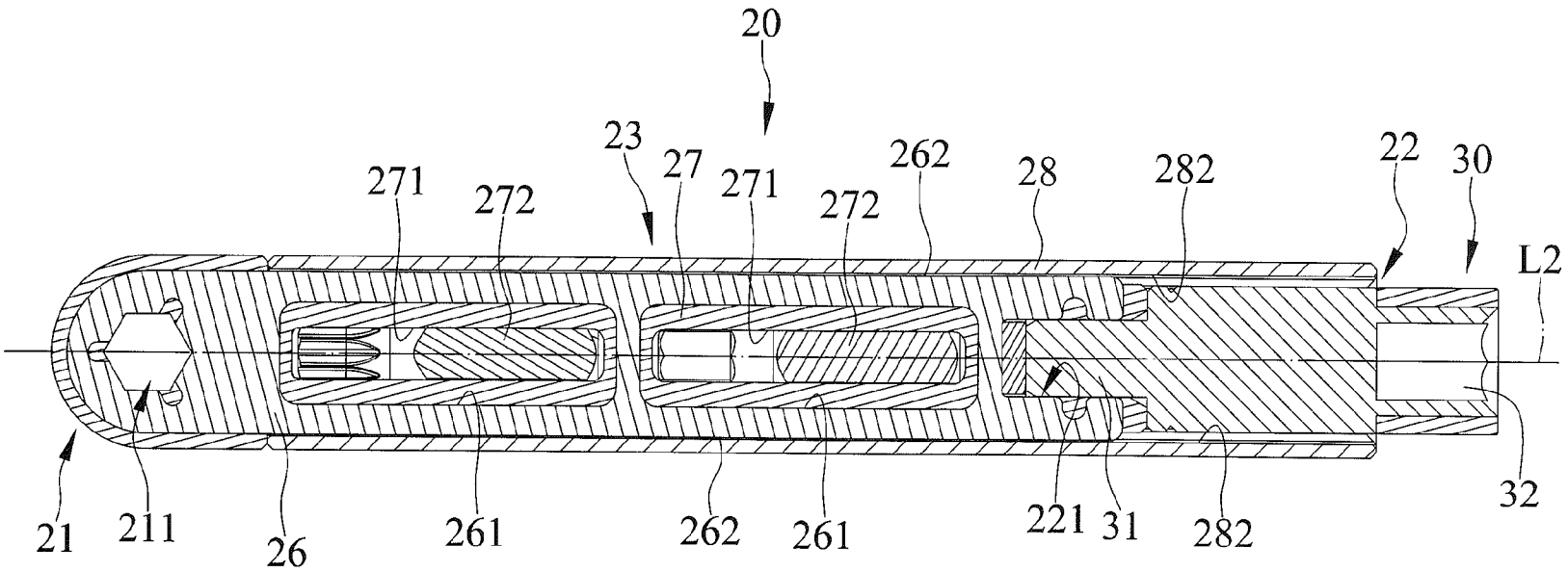
FIG. 6 is another cross sectional view of the hand tool of FIG. 1.
Figure 7:
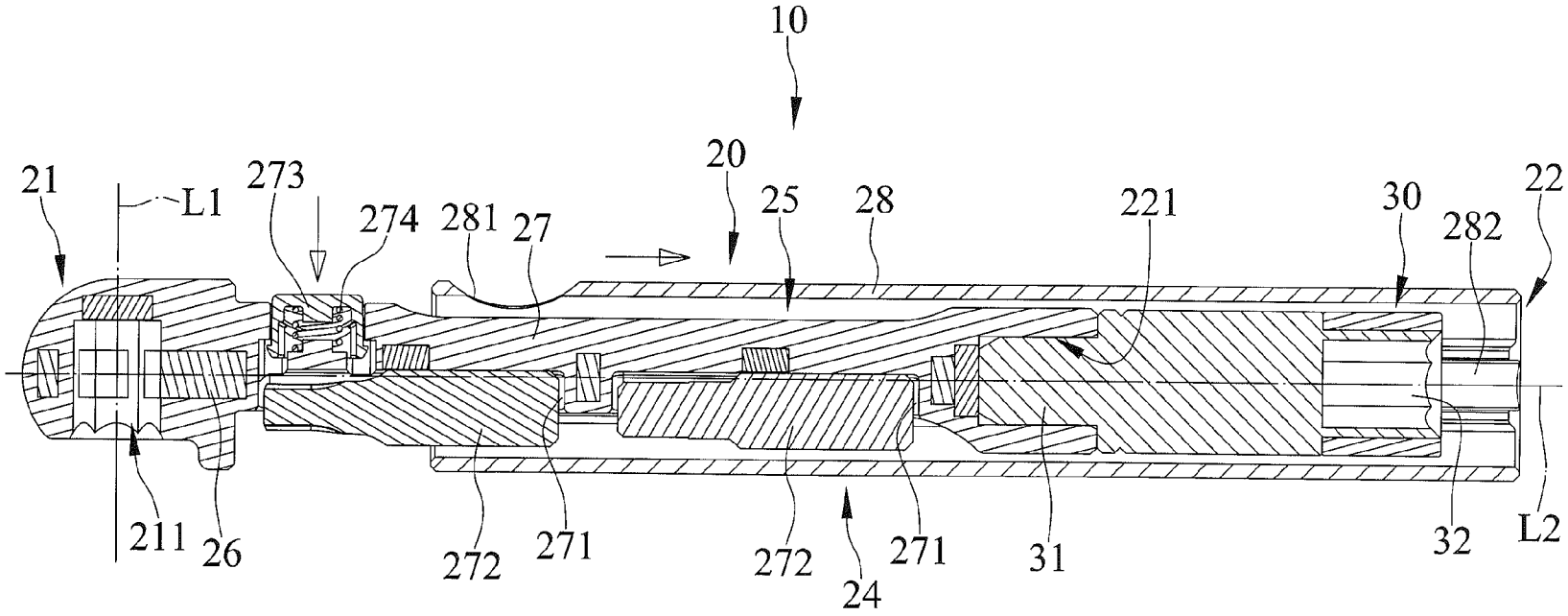
FIG. 7 is a continued view of FIG. 5, and illustrates the housing detached from the cover member.
Figure 8:
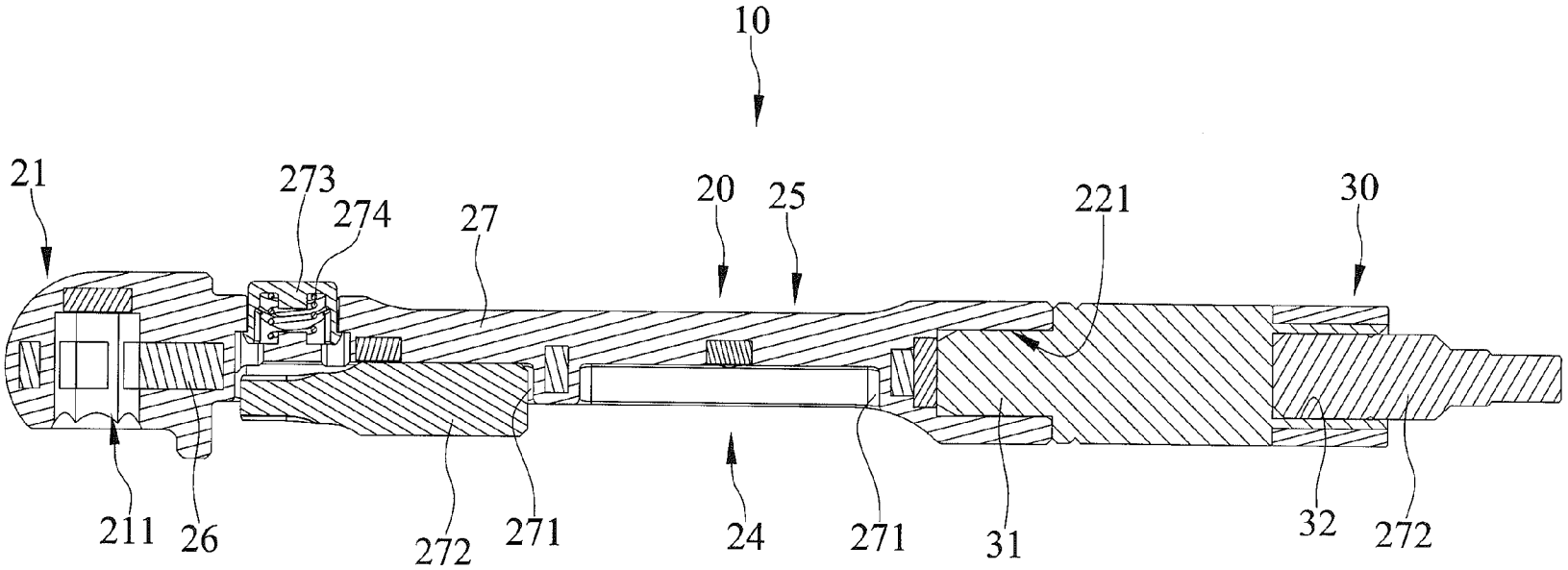
FIG. 8 is a continued view of FIG. 7, and illustrates a tool bit removed from a receiving recess and engaged into a third driving recess.
Figure 9:
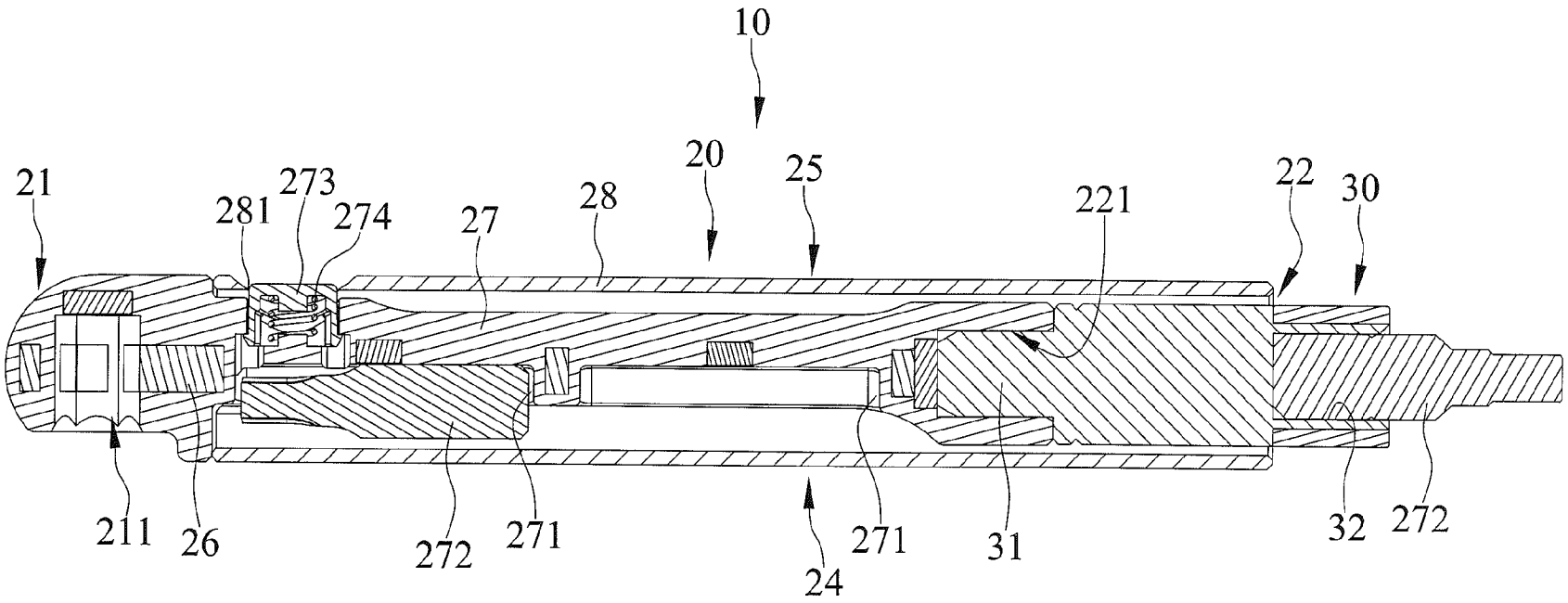
FIG. 9 is a continued view of FIG. 8, and illustrates the housing reattached to the cover member.
Figure 10:
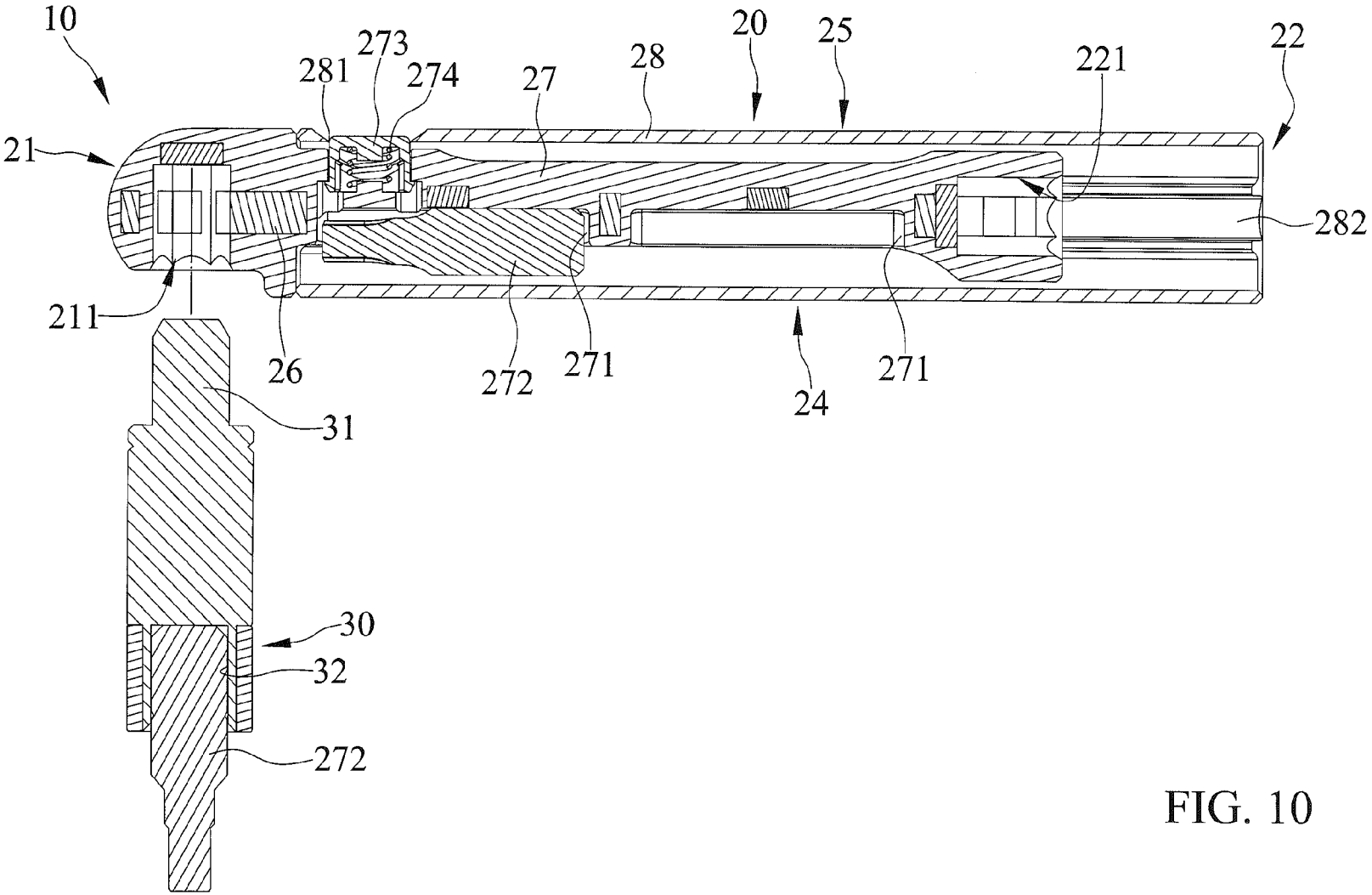
FIG. 10 is another continued view of FIG. 7, and illustrates the tool bit removed from the receiving recess and engaged into a first driving recess.
Figure 11:
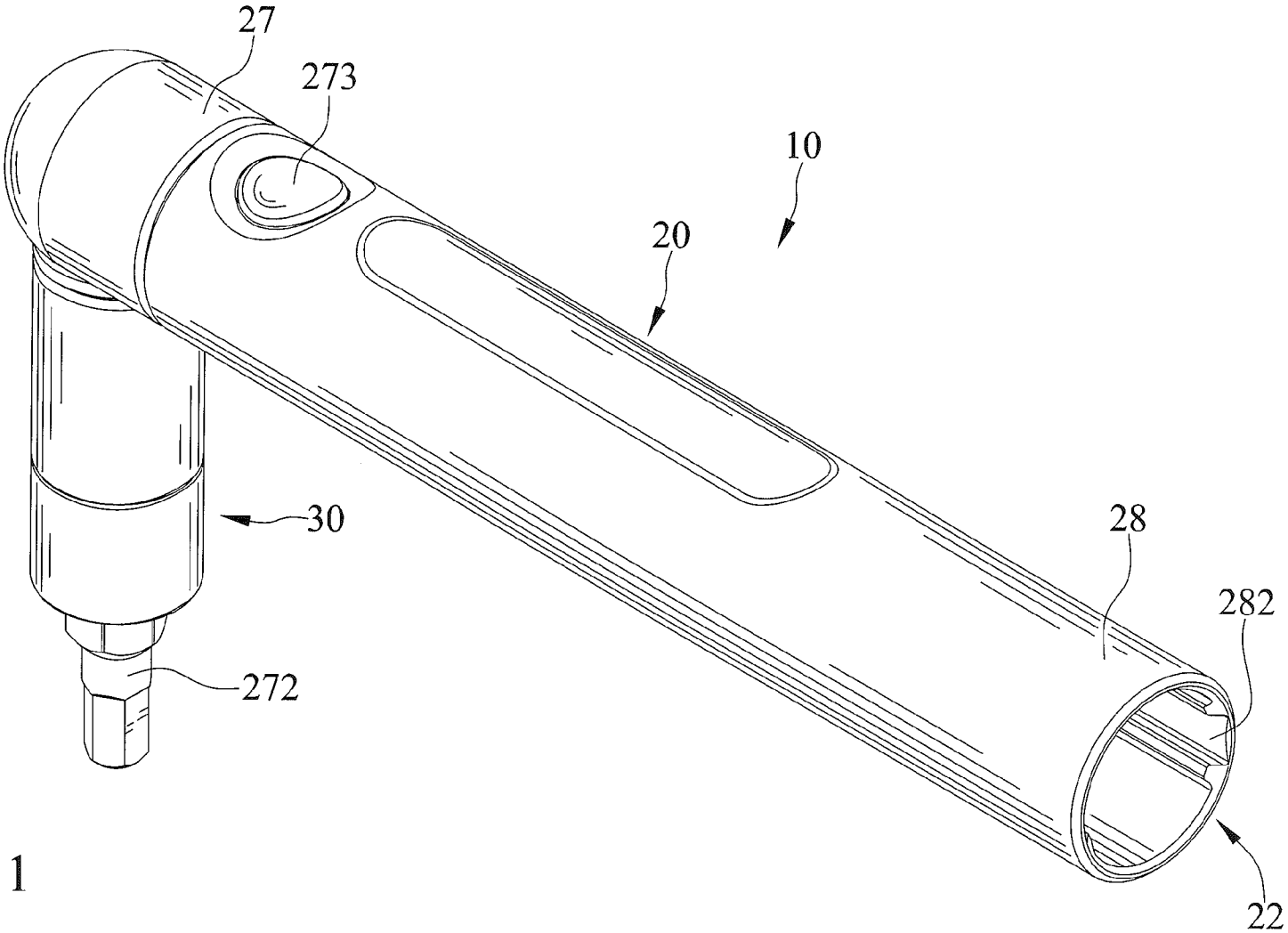
FIG. 11 is a perspective view of the hand tool according to the present invention, and illustrates the tool bit engaged into the first driving recess.

FIGS. 1-11 show a hand tool according to the present invention. The hand tool 10 includes a handle 20 and a driving head 30.

The handle 20 includes a first end 21, a second end 22 spaced from the first end 21 along an extending axis, an operating portion 23 disposed between the first and second ends 21 and 22, a first side 24, and a second side 25 spaced from the first side 24 along a first axis L1 perpendicular to the extending axis. The first end 21 includes a first driving recess 211 extending from the first side 24 to the second side 25 along the first axis L1. In the embodiment, the first driving recess 211 may be a polygonal aperture, such as a hexagonal aperture. One end of the first driving recess 211 adjacent to the second side 25 is closed and non-penetrates through the handle 20. The second end 22 includes a second driving recess 221 extending along a second axis L2 perpendicular to the first axis L1. One end of the second driving recess 221 adjacent to the first end 21 is closed and non-penetrates through the handle 20. In the embodiment, the second driving recess 221 may be a polygonal aperture, such as a hexagonal aperture.

The handle 20 further includes a body 26 extending from the first side 24 to the second side 25 and made of a first material, a cover member 27 mounted around an outer surface of the body 26 and made of a second material different from the first material, and a housing 28 detachably mounted around one end of the cover member 27 via the second end 22. The first driving recess 211 penetrates from one side towards the opposite side of the body 26. One end of the body 26 adjacent to the first end 21 is disposed around the first driving recess 211 to form a polygonal aperture, and another end of the body 26 adjacent to the second end 22 is C-shaped and connected to the second driving recess 221. The body 26 seals the one end of the second driving recess 221 adjacent to the first end 21, and two opposite sides of the second driving recess 221 extend parallel to the second axis L2.

In the embodiment, the body 26 is made of aluminum or an aluminum alloy. The body 26 includes a first through-recess 261 extending parallel to the first axis L1 and extending from the first side 24 towards the second side 25, and a second through-recess 261 aligned with the first through-recess 261 along the second axis L2. The body 26 further includes two engaging edges 262 arranged at two opposite sides of the operating portion 23 and extending parallel to the second axis L2.

In the embodiment, the cover member 27 is made of plastics. Moreover, the cover member 27 extends from the first end 21 to the second end 22 and may be formed by injection molding to cover around the outer surface of the body 26. The cover member 27 uncovers the two engaging edges 262, which is exposed out of the outer surface of the cover member 27. A first end of the cover member 27 adjacent to the first end 21 seals one end of the first driving recess 211 adjacent to the second side 25, and a second end of the cover member 27 adjacent to the second end 22 is disposed around the second driving recess 221 along the second axis L2 to form a polygonal aperture.

The cover member 27 includes a first receiving recess 271 formed therein and extending from the first side 24 to the second side 25 parallel to the first axis L1. The first receiving recess 271 non-penetrates through the cover member 27 and corresponds to the first through-recess 261. In the embodiment, the cover member 27 further includes a second receiving recess 271. Two tool bits 272 can be detachably received into the first and second receiving recesses 271, respectively.

The cover member 27 further includes a button 273 and a biasing member 274 both arranged adjacent to the second side 25. The button 273 is movable in relation to the cover member 27 along a direction parallel to the first axis L1 to expose out of an outer surface of the cover member 27. The biasing member 274 is disposed between the cover member 27 and the button 273 to abut against the cover member 27 and the button 273. The biasing member 274 biases against the button 273 to expose out of the outer surface of the cover member 27 in a nature state.

The housing 28 is adjacent to the operating portion 23 when the housing 28 is mounted around the cover member 27 via the second end 22. In the embodiment, the housing 28 is a hollow circular tube. The housing 28 includes a positioning hole 281 extending parallel to the first axis L1 to receive the button 273 when the housing 28 is mounted around the cover member 27. An inner surface of the housing 28 includes two concave edges 282 respectively extending along a direction parallel to the second axis L2 to engage with the two engaging edges 262 when the housing 28 is mounted around the cover member 27.

The handle 20 further includes first, second, and third magnetic members 29. The first magnetic member 29 is disposed at a bottom surface of the first driving recess 211 adjacent to the second side 25 and is connected within the cover member 27. The second magnetic member 29 is disposed at a bottom surface of the second driving recess 221 and connected within the body 26. The third magnetic member 29 is disposed at a bottom surface of the receiving recess 271 adjacent to the second side 25.

The driving head 30 includes a connection portion 31 alternatively engaged into one of the first driving recess 211 and the second driving recess 221, and a third driving recess 32 formed opposite to the connection portion 31. In the embodiment, the connection portion 31 is a hexagonal column, and the third driving recess 32 is a polygonal aperture. The tool bits 272 are detachably received into the first and second receiving recesses 271, or engaged into the third driving recess 32.

A user can press this button 273, and then detach the housing 28 from the cover member 27 via the second end 22. Thus, one desired tool bit 272 can be removed from the first or second receiving recesses 271 and can be engaged into the third driving recess 32. The user can hold and turn the handle 20 to cause the driving head 30 turning the tool bit 272 for turning a fastener.

Besides, the user can engage the driving head 30 into the first driving recess 211, and make the driving head 30 perpendicular to the handle 20, to extend an arm of force while turning the fastener to increase the torque applied directly to the fastener.

By receiving the tool bits 272 into the first and second receiving recesses 271 within the handle 20, and since the body 26 and the cover member 27 are respectively made of different materials, a compact, lightweight, and easy to carry hand tool 10 is provided.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A hand tool comprising:

a handle having a first end, a second end spaced from the first end along an extending axis, a first side, and a second side spaced from the first side along a first axis perpendicular to the extending axis, with the first end including a first driving recess extending from the first side towards the second side along the first axis, with the second end including a second driving recess extending along a second axis perpendicular to the first axis, with the handle including a body extending from the first side to the second side, and a cover member mounted around an outer surface of the body, with the handle further including a first receiving recess extending parallel to the first axis, with the body including a first through-recess extending parallel to the first axis, with the first receiving recess formed within the cover member, with the first receiving recess non-penetrating through the cover member, with the first receiving recess corresponding to the first through-recess;

a button and a biasing member arranged adjacent to the second side of the handle, with the biasing member disposed between the cover member and the button to abut against the cover member and the button;

a housing detachably and slideably mounted around one end of the cover member via the second end, with the housing having annular cross sections and slideable on the cover member parallel to the extending axis between a first position and a second position, with the housing including a positioning hole extending parallel to the first axis, with the button movable in relation to the cover member along a direction parallel to the first axis, with the button received in the positioning hole in the first position to lock the housing on the handle with the housing extending over the first receiving recess, and with the button not received in the positioning hole in the second position, with the biasing member biasing the button into the positioning hole in the first position; and a driving head including a connection portion alternatively engaged into one of the first driving recess and the second driving recess, with the driving head including a third driving recess formed opposite to the connection portion, and with a tool bit detachably received into one of the first receiving recess and the third driving recess.

2. The hand tool as claimed in claim 1, with the body made of a first material, and a with the cover member made of a second material different from the first material.

3. The hand tool as claimed in claim 2, with one end of the first driving recess adjacent to the second side being closed and non-penetrating through the handle, and with one end of the second driving recess adjacent to the first end being closed and non-penetrating through the handle.

4. The hand tool as claimed in claim 2, with one end of the body adjacent to the first end disposed around the first driving recess to form a polygonal aperture, with another end of the body adjacent to the second end being C-shaped and connected to the second driving recess, with the body sealing one end of the second driving recess adjacent to the first end, with two opposite sides of the second driving recess extending parallel to the second axis, with a first end of the cover member adjacent to the first end sealing one end of the first driving recess adjacent to the second side, and with a second end of the cover member adjacent to the second end disposed around the second driving recess along the second axis to form a polygonal aperture.

5. The hand tool as claimed in claim 2, with the body further including a second through-recess aligned with the first through-recess along the second axis, and with the cover member further including a second receiving recess.

6. The hand tool as claimed in claim 2, with the body made of aluminum, with the cover member made of plastics, and with the cover member formed by injection molding to cover around the outer surface of the body.

7. The hand tool as claimed in claim 1, with the handle including an operating portion disposed between the first and second ends, with the body including two engaging edges arranged at two opposite sides of the operating portion and exposed out of the outer surface of the cover member, and with an inner surface of the housing including two concave edges respectively extending along a direction parallel to the second axis to engage with the two engaging edges when the housing is mounted around the cover member.

8. The hand tool as claimed in claim 1, with the handle including first, second, and third magnetic members, with the first magnetic member disposed at a bottom surface of the first driving recess adjacent to the second side and connected within the cover member, with the second magnetic member disposed at a bottom surface of the second driving recess and connected within the body, and with the third magnetic member disposed at a bottom surface of the receiving recess adjacent to the second side.

9. The hand tool as claimed in claim 8, with the first driving recess, the second driving recess, and the third driving recess each being a polygonal aperture, and with the connection portion being a hexagonal column.

10. The hand tool as claimed in claim 1, wherein the first end including the first driving recess has a cross sectional size larger than the cover member upon which the housing is slideably mounted, with the housing abutting with the first end in the first position.

* * * * *